US005775234A

United States Patent [19]

Solomon et al.

[11] Patent Number: 5,775,234

[45] Date of Patent: Jul. 7, 1998

[54] HEIGHT ADJUSTABLE OVERBED TABLE AND LOCKING DEVICE THEREFOR

[75] Inventors: Robert A. Solomon; Mark E. Borton, both of Kalamazoo, Mich.

[73] Assignee: BISSELL Inc., Grand Rapids, Mich.

[21] Appl. No.: 731,287

[22] Filed: Oct. 11, 1996

Related U.S. Application Data

[60] Provisional application No. 60/005,221 Oct. 12, 1995.

[51] Int. Cl.[6] ..... A47B 9/00

[52] U.S. Cl. ..... 108/147; 108/148

[58] Field of Search ..... 292/305, 306; 108/20, 144, 147; 403/109, 110; 248/410

[56] References Cited

U.S. PATENT DOCUMENTS

| | | | |
|---|---|---|---|
| 836,303 | 11/1906 | Christensen | 108/148 |
| 4,715,295 | 12/1987 | Hartman et al. . | |
| 4,910,816 | 3/1990 | Lansing . | |

FOREIGN PATENT DOCUMENTS

| | | | |
|---|---|---|---|
| 3422447 | 1/1985 | Germany | 108/147 |
| 8800880 | 11/1989 | Netherlands | 108/147 |
| 2106377 | 4/1983 | United Kingdom | 108/147 |

*Primary Examiner*—Peter M. Cuomo
*Assistant Examiner*—Gerald A. Anderson
*Attorney, Agent, or Firm*—Rader, Fishman, Grauer & McGarry

[57] ABSTRACT

A height adjustable bedside table having a gas spring with a gas cylinder and reciprocating shaft and a locking mechanism that locks the shaft against movement with respect to the cylinder while maintaining a common longitudinal axis of the cylinder and shaft. The locking mechanism is mounted to the gas cylinder and includes a locking plate having an aperture which receives the reciprocating shaft to selectively lock the shaft with respect to the cylinder. The locking plate is mounted for selective movement to lock the shaft in one position and to free the shaft for longitudinal movement with respect to the locking plate in another position. A locking plate spring is mounted to the one frame member for biasing the locking plate to the one position.

25 Claims, 4 Drawing Sheets

HEIGHT ADJUSTABLE OVERBED TABLE AND LOCKING DEVICE THEREFOR

This application claims the benefit of U.S. Provisional Application Ser. No. 60/005,221 filed on Oct. 12, 1995.

BACKGROUND OF THE INVENTION

1. Field of the Invention

This invention relates to overbed tables. In one of its aspects, the invention relates to an overbed table having a gas-assisted lift and a locking device for locking the table in an adjusted position. In another of its aspects, the invention relates to a gas lift and locking assembly for an overbed table.

2. Description of the Related Art

In hospitals or other health care facilities, many patients are often confined to bed over an extended period of time. Under these circumstances, a portable table is usually provided that can be positioned over the patient's bed to allow the patient to accomplish functions such as eating and personal hygiene. Typically, the portable table includes a table top mounted to a support tube which is in turn mounted to a wheeled base portion. The support tube may include an adjustment mechanism to raise and lower the height of the table top depending on the height of the bed and the individual needs of the patient. In use, the approximate height of the table top is adjusted and the base portion is wheeled under the bed such that the table top extends over the bed. A final height adjustment is then made to bring the table top into a comfortable position for the patient. A locking mechanism is usually provided for preventing relative movement between the table top and base once the table is adjusted.

In the past, the adjustment mechanism has typically included a coil spring or gas spring to counterbalance the weight of the table top and a portion of the support tube to facilitate height adjustment. Gas springs typically comprise a gas cylinder and a reciprocating rod protruding therefrom. They are particularly advantageous over coil springs since a substantially constant spring force is maintained throughout the stroke length of the reciprocating rod.

A typical prior art overbed table having a gas spring adjustment and locking mechanism is disclosed in U.S. Pat. No. 4,715,295 issued to Hartman et al. on Dec. 29, 1987. In this patent, a gas spring is mounted in a tube assembly having an upper tube and a lower tube that telescopes into the upper tube. The gas spring has a cylinder that is mounted against movement with respect to the upper tube and a reciprocating rod that is mounted against movement with respect to the lower tube. A locking mechanism includes an eccentric countersink that is secured to the free end of the reciprocating rod. In the locked position, the rod is cocked with respect to the cylinder due to the eccentric countersink to prevent downward movement of the cylinder with respect to the rod. A release rod is operable to pivot the eccentric countersink and thereby straighten the reciprocating rod with respect to the cylinder to allow free movement therebetween.

SUMMARY OF THE INVENTION

According to one embodiment of the invention, the bedside table includes a generally horizontal upper panel, a base for resting on a floor, and a height adjustable support assembly mounted between the upper panel and the base. The height adjustable support assembly comprises an upper frame support member having one end attached to the upper panel and a lower frame support member having one end attached to the base. The upper and lower frame support members are vertically slidable with respect to each other.

A locking mechanism is mounted to one of the upper and lower frame support members for releasably fixing the position of the upper frame support member with the lower frame support member. An elongated shaft is mounted to the other of the upper and lower frame support members and is engageable with the locking mechanism. In a preferred arrangement, the locking mechanism comprising a locking plate having an aperture which receives the elongated shaft to selectively lock the upper frame member with respect to the lower frame member. The locking plate is mounted for selective movement to lock the elongated shaft in one position and to free the shaft for longitudinal movement with respect to the locking plate in another position. A locking plate spring is mounted to the one frame member for biasing the locking plate to the one position. Preferably, an actuator rod has a first end mounted to the locking plate and a second end operatively associated with an actuator handle that is external to the one frame member. The actuator rod extends along the one frame member between the locking plate and actuator handle such that movement of the actuator rod in one direction selectively moves the locking plate to the other position for freeing the shaft for longitudinal movement with respect to the locking plate.

A counterbalance mechanism is also associated with the upper and lower frame support members for biasing the upper frame support member upwardly with respect to the lower frame support member. Preferably, the counterbalance mechanism is a gas spring and the elongated shaft forms a part of the gas spring.

The locking member further comprises a generally semi-cylindrical shell mounted to the gas cylinder having an integrally molded guide flange with an aperture which receives the actuator rod. The locking plate spring is preferably integrally formed with the shell and is in vertical alignment with the guide flange.

The locking mechanism also includes a support base having a slot for pivotably mounting the locking plate. Locking connections extend from the support base for mounting the support base to the shell. The gas cylinder preferably has grooves and the shell and support base have beads which are received in the gas cylinder grooves.

According to a further embodiment, a locking device for a cylinder that has an elongated shaft extending outwardly therefrom for reciprocating movement with respect to the cylinder, includes a locking plate having an aperture which receives the elongated shaft to selectively lock the elongated shaft with respect to the cylinder. The locking plate is preferably mounted for selective movement to lock the elongated shaft in one position and to free the shaft for longitudinal movement with respect to the locking plate in another position. A locking plate spring is mounted to the cylinder for biasing the locking plate to the one position.

These and other objects, features and advantages will be apparent from the ensuing description taken in conjunction with the accompanying drawings.

BRIEF DESCRIPTION OF THE DRAWINGS

The invention will now be described with reference to the drawings in which.

DETAILED DESCRIPTION OF THE PREFERRED EMBODIMENTS

Figure 1:
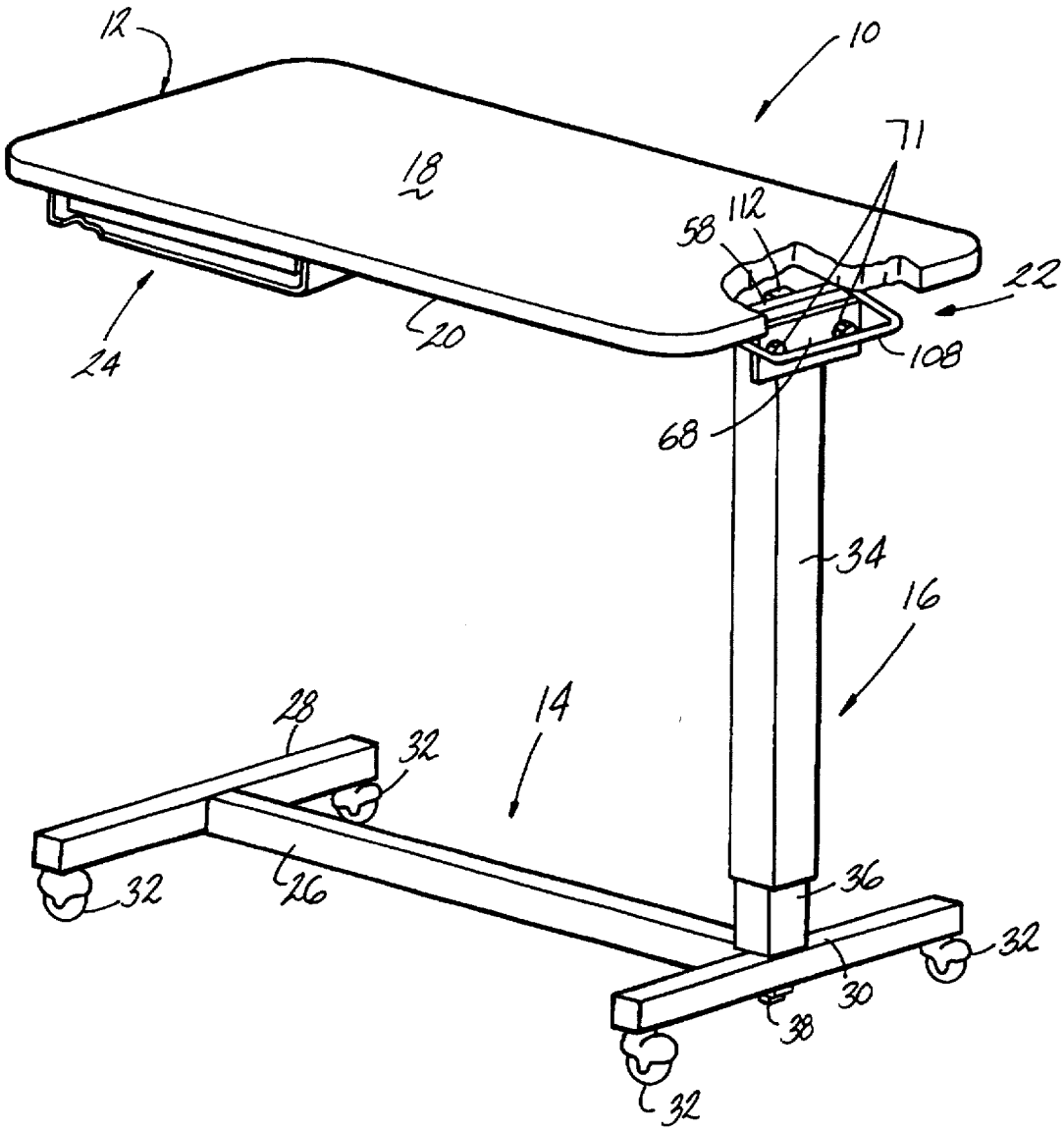
FIG. 1 is a perspective view of a bedside table according to the invention.

Referring now to FIG. 1, a bedside table 10 comprises a table top 12 that is supported on a base 14 through a height adjustment support assembly 16. The table top 12 includes an upper surface 18 and a lower surface 20. A portion of the table top 12 is broken away to reveal part of a lock release mechanism 22 for adjusting the table top 12 to various vertical positions as will be described in greater detail below. The lower surface 20 of the table top 12 can include a well-known tray and mirror assembly 24 mounted thereto.

The base 14 includes a longitudinally extending beam 26 and a pair of cross members 28, 30 attached at their mid-sections to either end of a beam 26. A set of swivel casters 32 are installed at the outer ends of each cross member 28 and 30 in a well-known manner in order to facilitate movement of the bedside table 10.

The height adjustment support assembly 16 as shown in FIG. 1 includes an upper square-shaped tube 34 ridgedly attached to the table top 12 and a lower tube 36 that is ridgedly attached to the base 14 through a fastener 38, such as a bolt that passes through the cross member 30 and is screwed into a lower portion of the lower tube 36. The lower tube 36 is telescopically received within the upper tube 34 such that the height of table top 12 can be adjusted.

Figure 2:
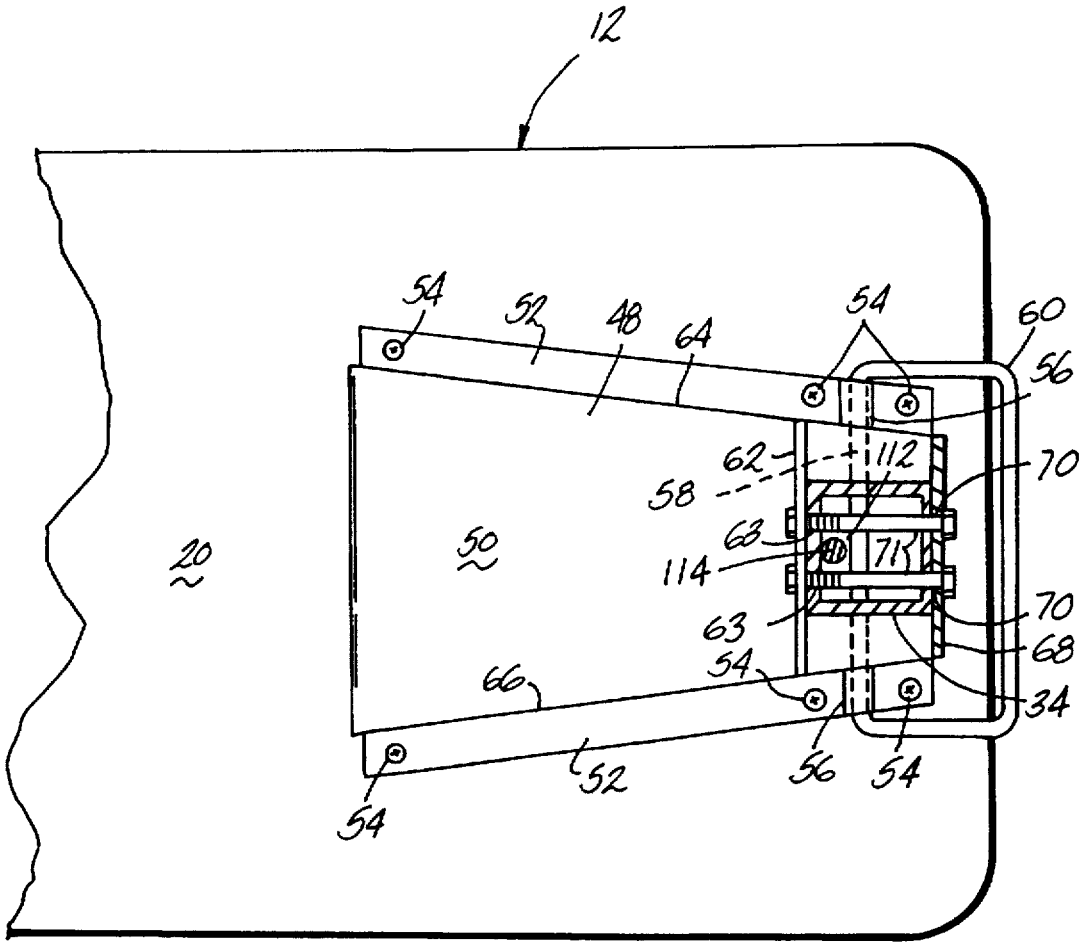
FIG. 2 is a bottom plan view of a portion of the bedside table.
Figure 3:
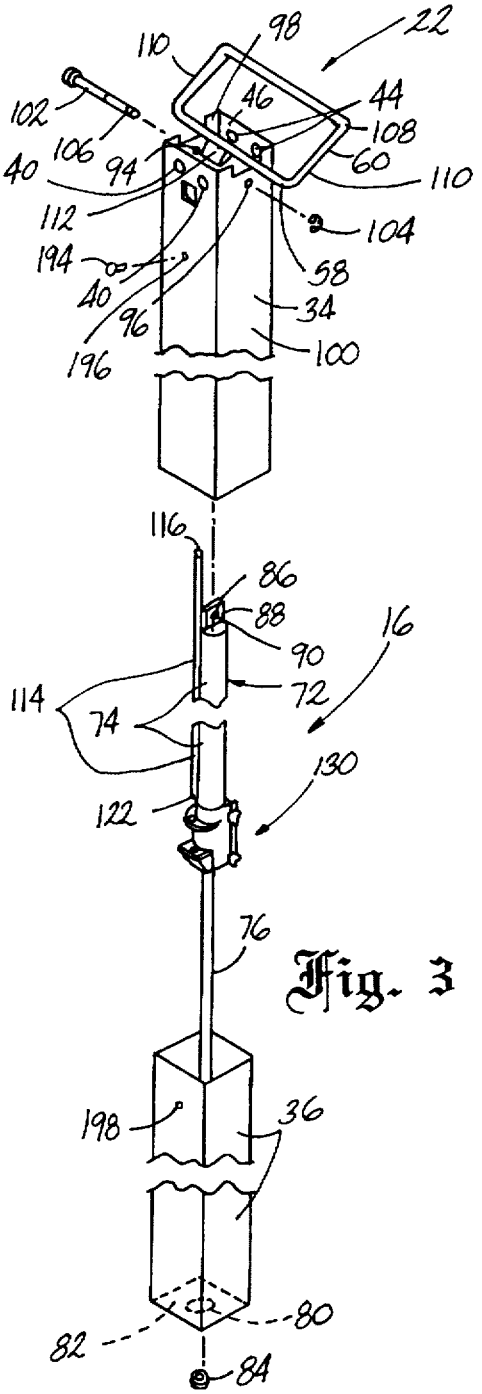
FIG. 3 is an exploded perspective view of a table height adjustment assembly according to the invention.

With reference now to FIGS. 1–3, an upper portion of the upper tube 34 includes a first set of apertures 40 in a side wall 42 and a second pair of apertures 44 in a side wall 46. A mounting bracket 48 has a raised center section 50 and a pair of opposed flanges 52 that extend laterally therefrom. Fasteners 54 fit through apertures (not shown) in the flanges 52 and screw into the lower surface 20 of the table top 12 for securely fastening the mounting bracket 48 thereto. Each flange 52 includes a U-shaped channel 56 to receive and hold the hinge arm 58 of a lock actuating lever 60, the details of which will be described in greater detail below. A first mounting plate 62 includes a pair of apertures 63 and extends between side walls 64 and 66 of the raised center section 50. The plate 62 is welded or otherwise securely attached to the center section 50 and the side walls 64, 66. A second mounting plate 68 has a pair of apertures 70 that is aligned with the pair of apertures 63 in the first mounting plate 62 when in the installed position against the raised center section 50. A pair of fasteners 71 extend through the pair of apertures 70 of the second mounting plate 68, the aligned apertures 44 and 40 in the upper portion of the upper tube 42, and the aligned aperture 63 in the first mounting plate 62, in order to securely attach the upper tube 34 to the table top 12. Although the tubes as illustrated are square-shaped in cross section, it is to be understood that the tubes may be of other cross sectional shapes, such as round, oval, rectangular, etc.

Figure 4:
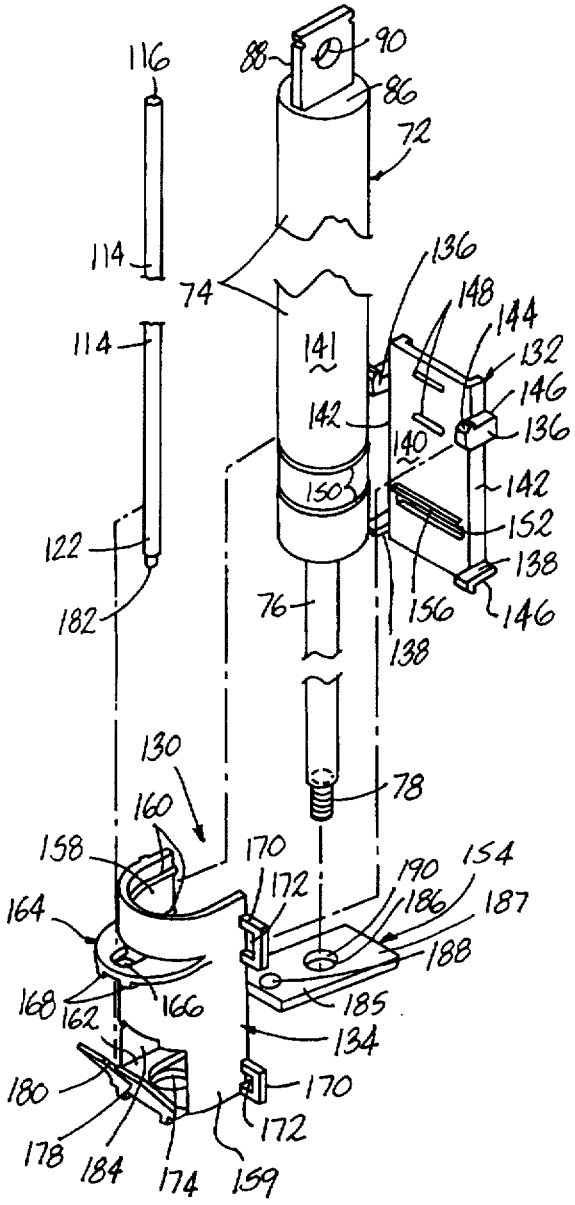
FIG. 4 is an enlarged, exploded perspective view of a locking mechanism that forms part of the table height adjustment assembly of FIG. 3.

With reference now to FIGS. 3 and 4, the height adjustment support assembly 16 further includes a gas spring 72 having a gas cylinder 74 with a shaft 76 extending outwardly therefrom for reciprocating movement with respect to the gas cylinder 74. The reciprocating shaft 76 extends into the gas cylinder 74 and includes a piston (not shown) that encloses a gas under pressure in the gas cylinder 74. Shaft 76 is normally biased outwardly of the gas cylinder and includes a lower threaded portion 78 extending through a central opening 80 (shown in dashed line) and a lower end wall 82 (also shown in dashed line in FIG. 3) of the lower tube 36. A threaded nut 84 fits onto the lower threaded portion 78 to secure the shaft 76 to the lower tube 36. An upper end wall 86 of the gas cylinder 74 has affixed thereto a mounting plate 88 with an opening 90 that extends transverse to a central axis 92 of the gas spring 72. The opening 90 is aligned with a pair of apertures 94, 96 that extend through a pair of side walls 98, 100, respectively. The side walls 98, 100 extend between the side walls 42 and 46. A pin 102 extends through the apertures 94, 90 and 96 to mount the cylinder 74 to the upper portion of the upper tube 34. A C-clip 104 fits into a groove 106 of the pin 10 to thereby secure the pin to the tube 34. The gas cylinder serves as a counterbalance to the weight of the upper horizontal panel 12 and the upper tube 34 to facilitate vertical adjustment of the panel.

The actuating lever 60 of the lock release mechanism 22 includes a handle 108 that is adapted to be grasped by a user when adjusting the height of the table top 12. The handle 108 is substantially parallel with the hinge arm 58 and is attached thereto through a pair of side arms 110 that extend between ends of the handle and hinge arm. Preferably, the actuating lever 60 is formed from a single piece of round bar stock and is bent into a generally rectangular shape. A lever arm 112 in the form of a plate is welded at one edge thereof to the hinge arm 58. The lever arm preferably extends at an angle $\alpha$ (FIG. 5) of approximately 15° with respect to the lower surface of the actuating lever 60.

Figure 5:
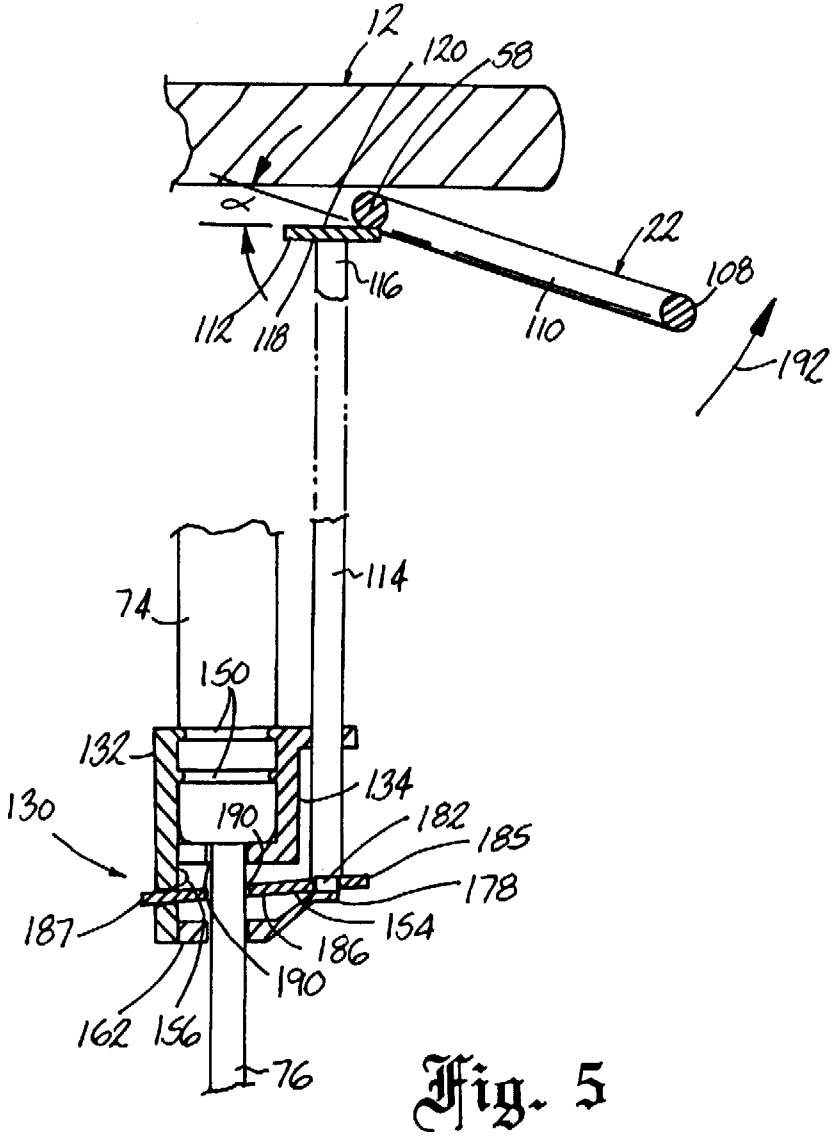
FIG. 5 is a side elevational view of the locking mechanism in a normally locked position.

With reference now to FIG. 5, an actuator rod 114 is biased upwardly and has an upper end 116 that abuts a lower surface 118 of the lever arm 112 and a lower end 122 that is received in a locking mechanism 130. The rod 114 normally biases an upper surface 120 of the lever arm 112 against the lower surface 20 of the table top 12. In this position, the lever arm 112 extends substantially horizontal while the handle 108 extends at an angle of approximately 15° below the horizontal in order to provide adequate room for grasping and rotating the handle 108 upward to thereby release the locking mechanism 130.

Referring again to FIGS. 3 and 4, the locking mechanism 130 includes a generally planar base plate 132 that is attachable to a generally semi-cylindrical shell 134. The base plate 132 has a first pair of cantilevered locking tabs 136 at an upper end thereof and a second pair of cantilevered locking tabs 138 at a lower end thereof Each locking tab is formed integral with one of the sides 142 of base 132 and projects outwardly from and substantially perpendicular to a surface 140 that is adapted to contact an outer surface 141 of the cylinder 74. A catch is formed at the free end of each locking tab and includes a beveled surface 144 and an opposed surface 146. The beveled surfaces 144 of the locking tabs 136 face upwardly while the beveled surfaces 144 of the locking tabs 138 face downwardly. The surface 146 of each catch extends substantially parallel to the contact surface 140. Two elongate beads 148 on the base 132 protrude outwardly from the surface 140. A portion of the beads 148 are received into a pair of annular grooves 150 on a lower portion of the cylinder 74. A slot 152 extends through the base plate 132 and is sized to loosely receive a locking plate 154. An embossment 156 extends outward from the contact surface 140 and is formed adjacent an upper edge of the slot 152 and seats against the bottom surface of the bottom wall of shell 134. Preferably, the base plate 132 is integrally formed by injection molding from a plastic material.

The shell 134 comprises a curved side wall 157 attached to a bottom wall 162. The side wall 157 includes an inner surface 158 and an outer surface 159. The inner surface 158 contacts the outer surface 141 of the cylinder 74 when the shell 134 is installed. A pair of annular beads 160 protrude from the inner surface 158 and are received into the pair of annular grooves 150 of the cylinder 74. A guide flange 164 projects substantially perpendicular from the outer surface 159 and includes a guide opening 166 for receiving the actuator rod 114 and a pair of reinforcing ribs 168 on either side of the opening 166. Four U-shaped arms 170 (only two of which are fully shown) extend laterally from the outer surface 159 at upper and lower ends of the shell 134. Each U-shaped arm 170 includes an opening 172 that receives a corresponding locking tab 136, 138 in a snap-fit engagement. The bottom wall 162 of the shell 134 has a central opening 174 for slidably receiving the reciprocating shaft 76. The internal diameter of the opening 174 is greater than the outside diameter of the shaft 76 such that the shaft can freely reciprocate in the opening. A spring arm 178 is integrally formed at an obtuse angle with the bottom wall 162 and extends outwardly from the outer surface 159. Preferably, the angle is approximately 130°, but may be more or less depending on the thickness of the spring arm and the amount of spring force desired. A slot 180 is formed in the spring arm 178 for receiving a reduced diameter portion 182 of the actuator rod lower end 122. An opening 184 extends through the side wall 157 adjacent to the spring arm 178 for receiving an end portion 185 of the locking plate 154. Preferably, the shell, including the spring arm, is integrally formed from a plastic material.

The locking plate 154 includes an aperture 186 with an internal diameter slightly greater than the outside diameter of the reciprocating shaft 76 such that the shaft can freely reciprocate in the aperture when the plate 154 is in the unlocked position. The intersections of the upper and lower plate surfaces with the aperture 186 define a pair of upper and lower peripherally extending inner edges 190. A smaller aperture 188 extends through the thickness of the locking plate at the end 185 for receiving the reduced diameter portion 182 of the actuator shaft 114.

During assembly of the locking mechanism 130, the reciprocating shaft 76 of the gas spring 72 is inserted into the aperture 186 of the locking plate 154. The end 187 of the locking plate is then inserted into the slot 152 of the support base 132 and the elongate beads 148 are seated into the annular grooves 150 of the gas cylinder 74. The openings 172 in the U-shaped arms 170 of the shell 134 are then aligned with the locking tabs 136 while the other end 185 of the locking plate is guided into the opening 184 of the shell. The base 132 and shell 134 are then pressed together such that the beveled surfaces 144 of the tabs 136 ride along the upper or lower leg of the U-shaped arms 170 to thereby deflect the upper and lower pairs of tabs toward each other. When assembled, the annular beads 160 are seated within the annular grooves 150 of the cylinder and the surface 146 of each tab 136 engages the upper or lower arm to prevent the shell and base from coming apart. The actuator rod 115 is then inserted into the guide opening 166 such that the reduced diameter portion 182 passes through the small aperture 188 in the locking plate and abuts the spring arm 178. This assembly is then mounted in the upper and lower tubes 34, 36 as previously described. A screw 194 fits within an aperture 196 of the upper tube 34 and a threaded aperture 196 of the lower tube 36 to lock the tubes together during shipment.

Figure 6:
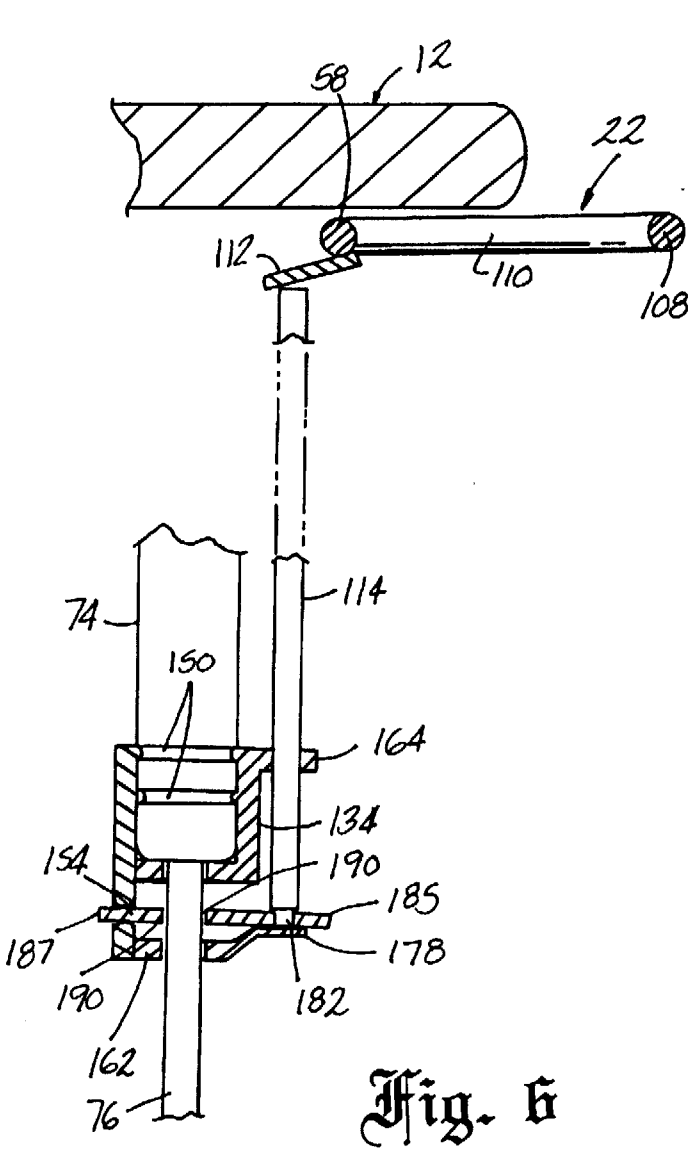
FIG. 6 is a side elevational view of the locking mechanism in an unlocked position.

Operation of the locking mechanism will now be described in conjunction with FIGS. 5 and 6. The end 185 of the locking plate 154 and the actuator rod 114 are normally biased upward by the spring arm 178. In this position, the upper and lower edges 190 of the aperture 186 are normally frictionally biased against the outer surface of the reciprocating shaft due to the spring arm 178 to thereby prevent relative downward movement of the cylinder 74 with respect to the shaft 76 and therefore downward movement of the table top 12. When the handle 108 of the lock release mechanism 22 is rotated in a direction as denoted by arrow 192 in FIG. 5, the lever arm 112 forces the actuator rod 114 downwardly against the bias of the spring arm 178 and pivots the end 185 of the plate 154 until the inner peripheral edges 190 of the aperture 186 no longer engage the reciprocating shaft 76 in a locking manner, as illustrated in FIG. 6. The table top 12 is then free to be adjusted to any desired height.

The table top 12 can also be adjusted upwardly without rotating the handle 108. As the table top 12 is pulled upwardly, the cylinder 74 is also pulled upwardly and causes the locking assembly 130 to move upwardly with respect to the shaft 76. The end 157 of the plate 154 also moves upwardly until the inner edges 190 of the aperture 186 no longer engage the shaft 76 in a locking manner.

Although this invention has been described in conjunction with overbed tables, it is to be understood that the locking and release mechanisms described herein can be used in other applications where locking adjustment between two members is desired.

While a particular embodiment of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments for which an exclusive property or privilege is claimed are defined as follows:

1. A locking device for a cylinder having an elongated shaft extending outwardly therefrom for reciprocating movement with respect to the cylinder, comprising:

a shell mounted to the cylinder with a spring integrally formed therewith;

a guide flange extending from the shell and having an aperture;

a locking plate having an opening which receives the elongated shaft, the locking plate being pivotally mounted to the cylinder, the spring normally biasing the locking plate in a first position to lock the shaft with respect to the cylinder;

an actuator rod extending through the guide flange aperture, the actuator rod having a first end mounted to the locking plate and a second end operatively associated with an actuator handle spaced from the locking plate, whereby movement of the actuator rod in one direction selectively moves the locking plate to a second position against the bias of the spring to thereby free the shaft for longitudinal movement with respect to the cylinder.

2. A height adjustable bedside table, comprising:

a generally horizontal upper panel, a base for resting on a floor, a height adjustable support assembly mounted between the upper panel and the base, the height adjustable support assembly comprising an upper frame support member having one end attached to the upper panel, a lower frame support member having one end attached to the base, the upper and lower frame support members being vertically slidable with respect to each other, a gas spring having a cylinder mounted to one of the upper and lower frame support members and an elongated shaft that reciprocates with respect to the cylinder mounted to the other of the upper and lower frame support members for biasing the upper frame support member upwardly with respect to the lower support member, a locking mechanism comprising a locking plate pivotally mounted to the cylinder of the gas spring, the locking plate having an aperture which slidably receives the elongated shaft to selectively lock the upper frame member with respect to the lower frame member, the locking plate being mounted for selective pivotal movement to lock the elongated shaft in one position and to free the shaft for longitudinal movement with respect to the locking plate in another position.

3. A height adjustable bedside table according to claim 2 and further comprising a locking plate spring mounted to the one frame support member for biasing the locking plate to the one position.

4. A height adjustable bedside table according to claim 3 and further comprising:

an actuator rod having a first end mounted to the locking plate and a second end operatively associated with an actuator handle external to the one frame member, the actuator rod extending along the one frame member between the locking plate and actuator handle, whereby movement of the actuator rod in one direction selectively moves the locking plate to the other position for freeing the shaft for longitudinal movement with respect to the locking plate.

5. A height adjustable bedside table according to claim 4 wherein the locking member comprises a shell and the locking plate spring is integrally formed with the shell.

6. A height adjustable bedside table according to claim 5 wherein the shell is mounted to the gas spring cylinder.

7. A height adjustable bedside table according to claim 6 wherein the locking member further comprises:

a support base having a slot through which the locking plate extends for pivotably mounting the locking plate and having locking connections that engage with the shell for mounting the support base to the shell.

8. A height adjustable bedside table according to claim 7 wherein the gas cylinder has axially spaced and circumferentially extending grooves and the shell has axially spaced beads which are received in the gas cylinder grooves.

9. A height adjustable bedside table according to claim 8 wherein the support base has axially spaced beads which are received in the gas cylinder grooves.

10. A height adjustable bedside table according to claim 9 wherein the shell is generally semi-cylindrical in shape.

11. A height adjustable bedside table according to claim 5 wherein the shell has a generally horizontally extending guide flange with an aperture which slidably receives the actuator rod for guiding movement of the actuator rod.

12. A height adjustable bedside table according to claim 11 wherein the locking plate spring is in vertical alignment with the guide flange.

13. A height adjustable bedside table according to claim 2 and further comprising a spring mounted to the cylinder for biasing the locking plate to the one position.

14. A height adjustable bedside table according to claim 13 and further comprising:

an actuator rod having a first end mounted to the locking plate and a second end operatively associated with an actuator handle external to the one frame member, the actuator rod extending along the one frame member between the locking plate and actuator handle, whereby movement of the actuator rod in one direction selectively moves the locking plate to the other position for freeing the shaft for longitudinal movement with respect to the locking plate.

15. A height adjustable bedside table according to claim 14 wherein the locking mechanism comprises a shell and the locking plate spring is integrally formed with the shell.

16. A height adjustable bedside table according to claim 15 wherein the shell has a generally horizontally extending guide flange with an aperture which slidably receives the actuator rod for guiding movement of the actuator rod.

17. A height adjustable bedside table according to claim 16 wherein the locking plate spring is in vertical alignment with the guide flange.

18. A locking device for a cylinder having an elongated shaft extending outwardly therefrom for reciprocating movement with respect to the cylinder, comprising:

a base member mounted to one side of the cylinder and having a slot extending therethrough;

a locking plate pivotally mounted in the slot of the base member and having an aperture which slidably receives the elongated shaft to selectively lock the elongated shaft with respect to the cylinder, the locking plate being mounted for selective pivotal movement to lock the elongated shaft in one position and to free the shaft for longitudinal movement with respect to the locking plate in another position; and a locking plate spring mounted to another side of the cylinder opposite the one side and in contact with the locking plate for biasing the locking plate to the one position.

19. A locking device according to claim 18 and further comprising a shell mounted to the cylinder and wherein the locking plate spring is integrally formed with the shell.

20. A locking device according to claim 19 wherein the support base has locking connections that engage with the shell for mounting the support base to the shell.

21. A locking device according to claim 20 wherein the cylinder has axially spaced and circumferentially extending grooves and the shell and support base have axially space beads which are received in the cylinder grooves.

22. A locking device according to claim 18 and further comprising an actuator rod having a first end mounted to the locking plate and a second end operatively associated with an actuator handle spaced from the locking plate, whereby movement of the actuator rod in one direction selectively moves the locking plate to the other position for freeing the shaft for longitudinal movement with respect to the locking plate and cylinder.

23. A locking device according to claim 22 and further comprising a shell mounted to the cylinder and wherein the locking plate spring is integrally formed with the shell.

24. A locking device according to claim 23 wherein the shell has a guide flange with an aperture which receives the actuator rod.

25. A locking device according to claim 24 wherein the locking plate spring is in vertical alignment with the guide flange.

* * * * *